US005878936A

United States Patent [19]

Adachi et al.

[11] Patent Number: 5,878,936

[45] Date of Patent: Mar. 9, 1999

[54] EXHAUST MECHANISM OF PNEUMATIC NAILING MACHINE

[75] Inventors: Michiaki Adachi; Nobuo Kishi; Yasunori Aihara; Tatsushi Ogawa; Makoto Kosuge; Motomitsu Hagiwara; Mitsugu Takezaki; Yasuhiro Naito, all of Tokyo, Japan

[73] Assignee: Max Co., Ltd., Tokyo, Japan

[21] Appl. No.: 657,882

[22] Filed: Jun. 7, 1996

[30] Foreign Application Priority Data

| | | | |
|---|---|---|---|
| Jun. 9, 1995 | [JP] | Japan | 7-168203 |
| Jun. 9, 1995 | [JP] | Japan | 7-168204 |
| Jun. 9, 1995 | [JP] | Japan | 7-168211 |

[51] Int. Cl.[6] ..... B25C 1/04

[52] U.S. Cl. ..... 227/130

[58] Field of Search ..... 237/130, 8, 10

[56] References Cited

U.S. PATENT DOCUMENTS

| | | | |
|---|---|---|---|
| 3,673,922 | 7/1972 | Doyle | 227/130 |
| 4,039,113 | 8/1977 | Males | 227/130 |
| 4,401,251 | 8/1983 | Nikolich | 227/130 |
| 4,503,585 | 3/1985 | Hamel et al. | 227/130 |
| 4,566,619 | 1/1986 | Kleinholz | 227/8 |
| 4,609,135 | 9/1986 | Elliesen | 227/130 |
| 5,110,030 | 5/1992 | Tanji | 227/130 |
| 5,181,450 | 1/1993 | Monacelli | 227/130 |
| 5,197,646 | 3/1993 | Nikolich | 227/8 |
| 5,259,465 | 11/1993 | Mukoyama et al. | 227/130 |
| 5,437,339 | 8/1995 | Tanaka | 227/130 |
| 5,476,205 | 12/1995 | Canlas et al. | 227/130 |

*Primary Examiner*—Scott A. Smith
*Attorney, Agent, or Firm*—Morgan, Lewis & Bockius LLP

[57] ABSTRACT

An exhaust mechanism of a pneumatic nailing in which a striking cylinder is accommodated in a body and a striking piston in the striking cylinder is driven to drive a nail when compressed air is supplied to and exhausted from an upper portion of the striking cylinder, comprises: an inner cap arranged in the upper portion of the striking cylinder; a cylinder cap covering the inner cap; an exhaust chamber formed along inside the body between the inner cap and the cylinder cap; and a throttle hole formed in a lower portion of the exhaust chamber, wherein the exhaust air exhausted from the upper portion of the striking cylinder is discharged from the throttle hole via the exhaust chamber.

11 Claims, 16 Drawing Sheets

6
14
12
13

11
2
2
10
3a
16
4
3b
7
9

EXHAUST MECHANISM OF PNEUMATIC NAILING MACHINE

BACKGROUND OF THE INVENTION

The present invention relates to an exhaust mechanism of a pneumatic nailing machine for discharging the exhaust air after a nail has been driven by the pneumatic nailing machine.

By a pneumatic nailing machine in which compressed air is used, a nail is driven when a driver is activated together with a striking piston incorporated into a striking cylinder into which compressed air is supplied. After the completion of driving a nail, the compressed air is directly discharged outside the nailing machine from an upper end of the striking cylinder.

Recently, it is allowed to use compressed air of high pressure for industrial use. Therefore, when compressed air of high pressure is used for a pneumatic nailing machine, it is possible to develop a compact, handy nailing machine, the capacity of which is the same as the capacity of a conventional nailing machine.

Although it is possible to obtain a large capacity when compressed air of high pressure is used, the level of exhaust sound is raised. In order to reduce the level of exhaust sound, it is considered to adopt a mechanism in which compressed air is discharged from the striking cylinder via an exhaust chamber.

However, even if exhaust air is discharged via the exhaust chamber, when it is directly discharged from the exhaust chamber, the wind pressure generated by the exhaust air is increased. Therefore, a cloud of dust is made, so that the worker feels uneasy and uncomfortable, and the nailing operation is affected. For this reason, it is desired to develop a mechanism capable of reducing the wind pressure caused by exhaust air. However, when a new mechanism is added to the nailing machine, the size of the overall nailing machine is increased.

Furthermore, although it is possible to obtain a nailing machine of high capacity by using compressed air of high pressure, the level of exhaust sound is raised. In order to reduce the level of exhaust air sound, several methods are provided, for example, an exhaust hole may be throttled, or a filter is arranged in the exhaust air passage. However, when these methods are adopted, the exhaust of air is delayed. Therefore, the striking piston returning performance is deteriorated when the striking piston returns after the completion of driving a nail. Further, the effect of sound reduction is not so high.

FIG. 18 shows a conventional pneumatic nailing machine shown in which a short cylindrical head valve is arranged on the upper outside of a striking cylinder 32. When a head valve 30 is opened, compressed air in an air chamber 31 flows into a clearance between the head valve 30 and the striking cylinder 32. Then, compressed air is suddenly supplied into the striking cylinder 32 from an upper end opening of the striking cylinder 32 as shown by the arrow in the drawing. By the pressure of the compressed air, the driver 34 is actuated together with a striking piston 33 arranged in the striking cylinder 32, so that a nail can be driven.

When the head valve 30 is opened and the compressed air of high pressure in the air chamber 31 flows into the clearance between the head valve 30 and the striking cylinder 32 as described above, the compressed air is suddenly expanded. Due to the above adiabatic expansion, the temperature of the compressed air is lowered. Therefore, the moisture contained in the compressed air is frozen on an upper outer circumferential surface "a" of the striking cylinder 31. Due to the foregoing, the head valve to control the supply and discharge of the compressed air is not properly operated, because the head valve can not be sealed properly so that the compressed air leaks out. Therefore, the following problems may be encountered. A striking force is not strong enough to drive a nail, or a lost nailing motion is conducted by the nailing machine.

SUMMARY OF THE INVENTION

The present invention has been accomplished to solve the above problems.

An object of the present invention is to provide an air exhaust mechanism of the pneumatic nailing machine capable of discharging exhaust air of low pressure without increasing the size of the nailing machine.

Another object of the present invention is to provide a sound reduction mechanism of a pneumatic nailing machine by arranging an exhaust chamber in the body of the pneumatic nailing machine without deteriorating the returning performance of the striking piston.

Still further object of the present invention is to provide a freeze proofing mechanism of the head valve of the pneumatic nailing machine by which the moisture contained in compressed air is prevented from freezing so that the head valve can be operated in a good condition at all times.

According to a first aspect of the present invention, there is provided an exhaust mechanism of a pneumatic nailing machine in which a striking cylinder-piston mechanism is accommodated in a cylindrical main body and the striking cylinder-piston mechanism having a striking cylinder and a striking piston accommodated therein, the exhaust mechanism comprising: a cylindrical cylinder cap having a bottom to cover an upper portion of the striking cylinder-piston mechanism, the lower end surface of the cylinder cap being butted to an upper end surface of the main body; a fixing bolt implanted in the cylinder cap, screwed into an attaching hole open onto the upper end surface of the main body; an inner cap arranged inside the cylinder cap, the inner cap accommodating a drive valve mechanism for changing over the connection of the striking cylinder between an air supply source and the atmosphere; an exhaust chamber formed between the inner cap and the cylinder cap, the exhaust chamber diffusing exhaust air sent from the striking cylinder-piston mechanism; a throttle hole for discharging exhaust air sent from the exhaust chamber, the throttle hole being formed inside at a lower end of the cylinder cap; a plurality of protrusions, the wall thickness of which is larger than other portions, arranged on the circumferential surface of the main body, the attaching hole being formed in each protrusion at predetermined intervals; and an exhaust cover having a large number of exhaust ports, the exhaust cover covering the outside of at least one thin recess formed between the protrusions adjacent to each other, wherein an exhaust passage is formed between the exhaust cover and the recess, and an upper end of the exhaust passage is open to the throttle hole.

According to a second aspect of the invention, there is provided an exhaust mechanism of a pneumatic nailing in which a striking cylinder is accommodated in a body and a striking piston in the striking cylinder is driven to drive a nail when compressed air is supplied to and exhausted from an upper portion of the striking cylinder, the exhaust mechanism comprising: an inner cap arranged in the upper portion of the striking cylinder; a cylinder cap covering the inner cap; an exhaust chamber formed along inside the body between the inner cap and the cylinder cap; and a throttle hole formed in a lower portion of the exhaust chamber, wherein the exhaust air exhausted from the upper portion of the striking cylinder is discharged from the throttle hole via the exhaust chamber.

It is preferable that the size of the throttle hole is adjustable.

According to a third aspect of the invention, there is provided a freeze proofing mechanism of the head valve of the pneumatic nailing machine comprising: a striking piston for driving a nail; a cylindrical striking cylinder into which the striking piston is slidably incorporated; an annular protruding edge arranged on an upper outside of the striking cylinder; a short cylindrical head valve arranged in an upper portion of the protruding edge on the same axis as that of the striking cylinder, the short cylindrical head valve capable of sliding upward and downward; and an air chamber for storing compressed air arranged outside the head valve, the improvement which comprises a cover integrally made of rubber for covering the protruding edge and the upper portion of the outer wall surface of the striking cylinder, wherein the air chamber is opened to the striking cylinder when the lower end of the head valve is separated from the protruding edge, and the air chamber is closed to the striking cylinder when the lower end of the head valve is contacted with the protruding edge.

According to the present invention, the exhaust air discharged from an upper portion of the striking cylinder after the completion of driving a nail is diffused into the exhaust chamber at a stroke, and then the exhaust air in the exhaust chamber is diffused and discharged from the throttle hole. Accordingly, compared with a case in which exhaust air is directly discharged outside, the level of exhaust sound is remarkably reduced. Since the exhaust chamber is formed along the side of the body, it is possible to form the exhaust chamber without increasing the total height of the nailing machine. Therefore, an increase in the size of the nailing machine can be avoided.

The upper end surface of the cylindrical body is butted to the lower end surface of the cylinder cap, and both of them are integrally connected with each other by fixing bolts. The exhaust cover is arranged outside the thin recess formed between the protrusions on the circumferential surface of the body. Since the body is formed to be cylindrical as described above, the pressure proof property can be ensured. In the body, the attaching hole for attaching the fixing bolt is formed in the protrusion, the wall thickness of which is large. However, the wall thickness of other portions is reduced. The recess formed in this way between the protrusions adjacent to each other is used as an attaching portion for attaching the exhaust cover. Due to the above arrangement, the total size of the body is not increased more than the needed size.

There are formed a large number of exhaust holes on the exhaust cover. Accordingly, the exhaust air discharged from the throttle hole is sent into the exhaust cover. Then it passes through the exhaust passage and diffuses from a large number of exhaust holes. Accordingly, the reduction of the sound level can be more enhanced, and the wind pressure of exhaust air can be reduced. Therefore, no dust is made during the operation of the nailing machine, and the operation can be smoothly conducted.

According to the second aspect, when compressed air is supplied to the striking cylinder, the striking piston is moved so that a nail can be driven. After the completion of driving the nail, the compressed air supplied to the striking cylinder is discharged from an upper portion of the striking cylinder. This exhaust air is diffused into the exhaust chamber and passes through the throttle hole. Then the exhaust air is diffused and discharged outside from the exhaust port of the exhaust cover.

As described above, the exhaust air exhausted from the striking cylinder is discharged into the exhaust chamber at a stroke and diffused outside from the throttle hole. Therefore, the exhaust time can be extended. Accordingly, as compared with a conventional structure in which the exhaust air is directly discharged outside, the level of sound of the exhaust air is remarkably reduced according to the structure of the invention. Especially when compressed air of high pressure is used, it is possible to obtain the same capacity as that of the conventional structure, by a striking piston, the size of which is smaller than the striking piston of the conventional structure. Accordingly, it is possible to form a sufficiently large exhaust chamber. Therefore, the exhaust air discharging mechanism of the present invention is effective when it is used for a nailing machine in which compressed air of high pressure is used.

Since the exhaust air is quickly discharged from the striking cylinder into the exhaust chamber at a stroke, the exhaust of air from the striking cylinder is not delayed. Accordingly, the returning performance of the striking piston is not deteriorated even when the level of exhaust sound is reduced.

In the present invention, the exhaust chamber is not provided in such a manner that a cover is simply attached to the outer circumference of the cylinder cap while a space is provided between the cylinder cap and the cover, but the exhaust chamber is formed along the side of the body. Accordingly, even if the height of the overall nailing machine is not increased, the exhaust air chamber can be positively formed in the nailing machine. From this viewpoint, the nailing machine can be made compact.

Furthermore, the size of the throttle hole of the exhaust chamber is adjustable. Accordingly, in a packing work in which they attach importance to the speed of driving nails even if the level of sound is raised, the size of the throttle hole may be increased. In a conventional architectural method in which they attach importance to the effect of sound reduction rather than the speed of driving nails, the size of the throttle hole may be decreased so as to enhance the effect of sound reduction.

According to the third aspect, the head valve is arranged in such a manner that the head valve surrounds an upper outside of the striking cylinder, and that the head valve slides upward and downward in the opening and closing operation. When the head valve is opened, a lower end of the head valve is separated from the protruding edge of the striking cylinder, so that an air passage between the striking cylinder and the head valve can be opened. Then, the compressed air of high pressure is supplied into the striking cylinder, and a nail is driven.

When the head valve is opened and the compressed air of high pressure is supplied into the striking cylinder as described above, the compressed air is suddenly expanded. Due to this adiabatic expansion, temperatures of the protruding edge of the striking cylinder and the upper outer wall surface are lowered. However, these portions are covered with the cover made of rubber. Accordingly, even if the moisture contained in the compressed air is frozen and ice is generated, it is difficult for the ice to adhere to the cover made of elastic rubber, the heat insulating property of which is high. Even if the ice adheres to the cover, it can be easily removed. Therefore, the removed ice is easily blown off by the compressed air. Accordingly, the compressed air passage can be effectively prevented from freezing. As a result, the head valve can be sealed in a good condition and no air leaks out. Accordingly, the head valve can be always operated properly.

DETAILED DESCRIPTION OF THE PREFERRED EMBODIMENTS

Figure 1:
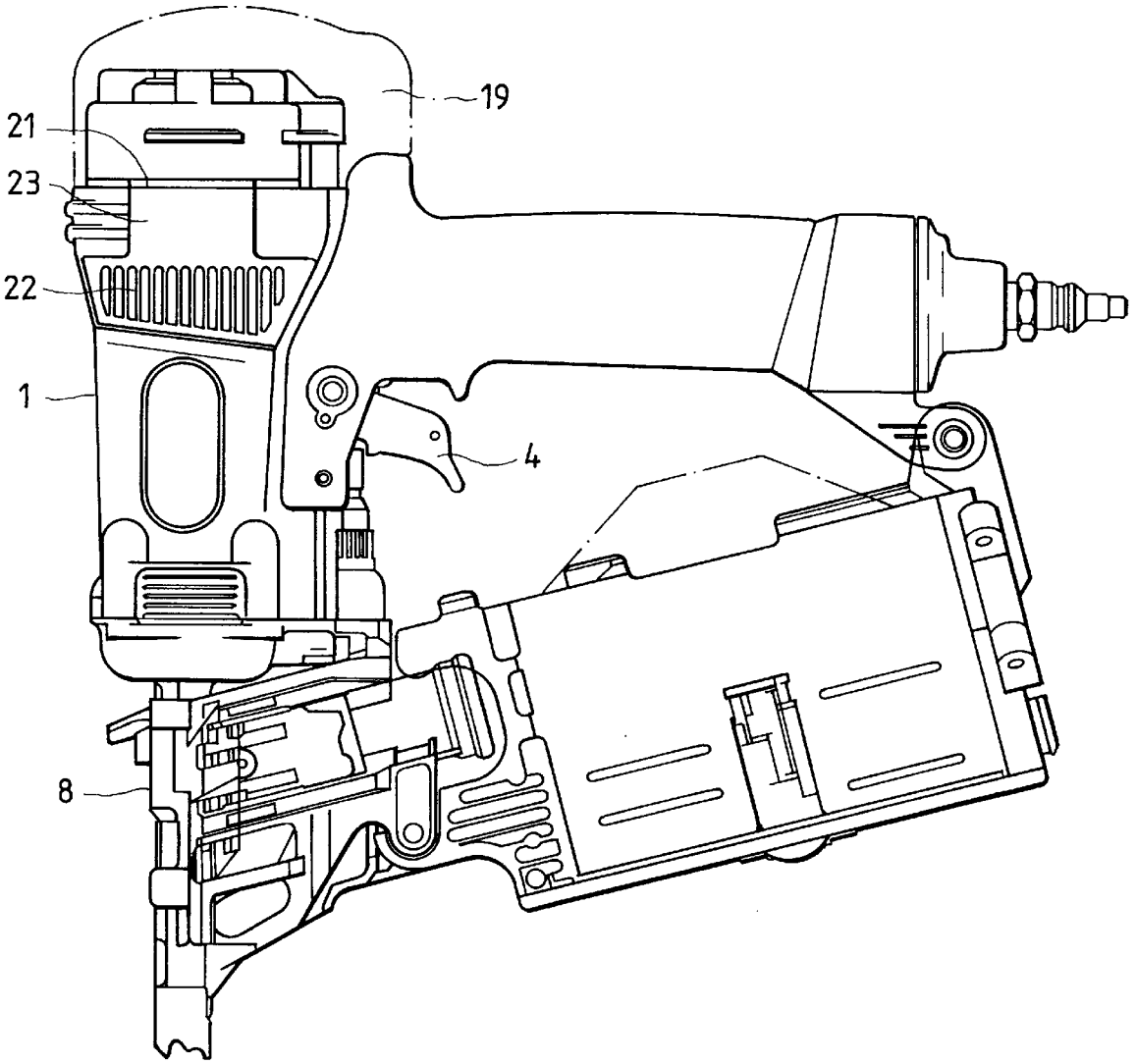
FIG. 1 is a side view of the nailing machine according to the present invention.
Figure 2:
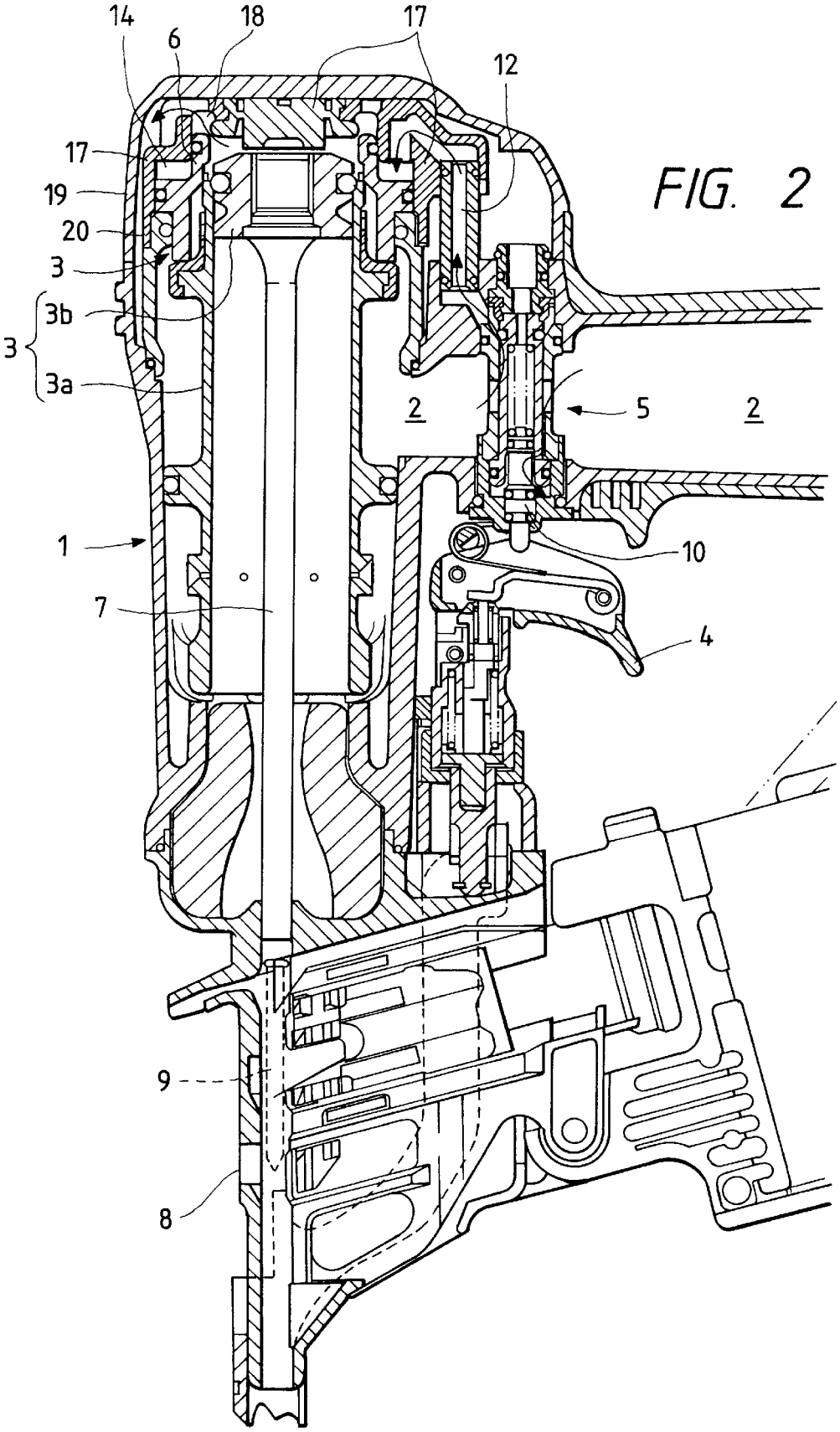
FIG. 2 is a longitudinal cross-sectional view of the above nailing machine.
Figure 3:
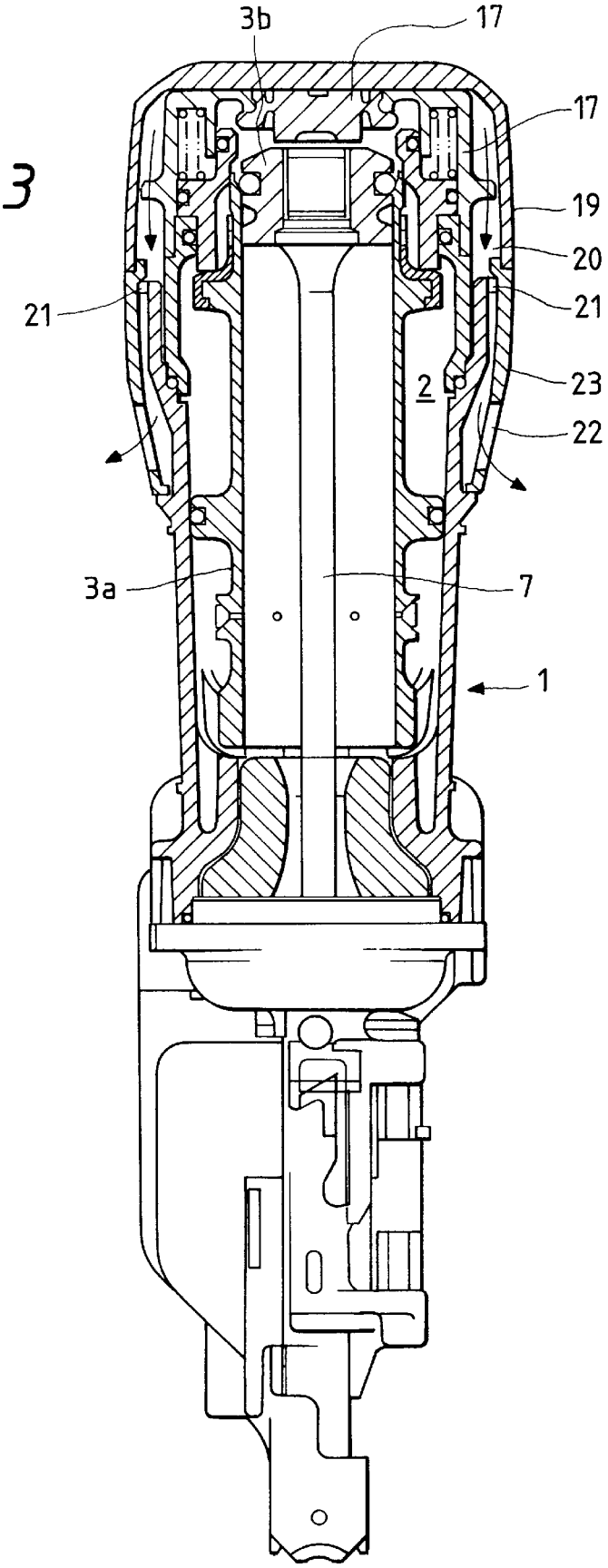
FIG. 3 is a longitudinal cross-sectional view of the primary portion of the body of the above nailing machine, wherein the view is taken on the cross section perpendicular to FIG. 2.

FIGS. 1, 2 and 3 are views showing a nailing machine of the present invention. In a body 1 of the nailing machine, there are provided an air chamber 2 to store compressed air supplied from a compressed air source (not shown), and a striking cylinder and piston mechanism 3. When a trigger lever 4 is pulled by an operator, compressed air is supplied to and discharged from a striking cylinder 3*a* by the operation of a start valve 5 and a head valve 6 which are interlocked with the trigger lever 4. By the action of the compressed air, a striking piston 3*b* is reciprocated in the striking cylinder 3*a*. Therefore, a driver 7 integrally connected with the striking piston 3*b* is shot to a nose portion 8 arranged at an end of the body 1, so that a nail 9 supplied to an outlet of the nose portion 8 is struck by the driver 7. In this way, the nail 9 is driven into an object to be nailed.

Figure 4:
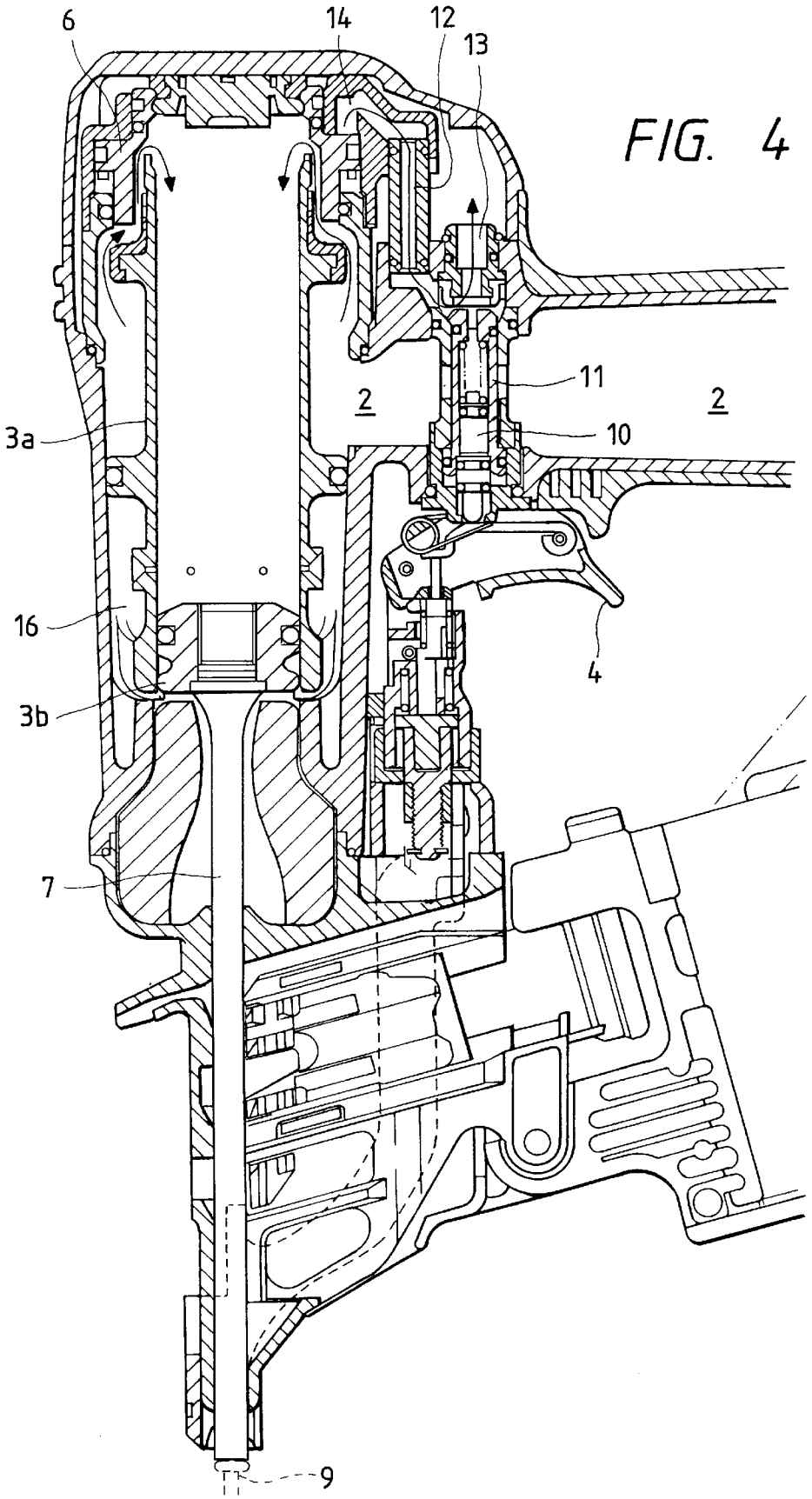
FIG. 4 is a longitudinal cross-sectional view of the primary portion of the body of the above nailing machine in the case of driving a nail.

As shown in FIG. 4, the trigger lever 4 pushes a stem 10 of the start valve 5, so that a pilot valve 11 is moved downward and an air passage 12 is open to an exhaust port 13. Due to the foregoing, compressed air in an upper chamber 14 of the head valve 6 is exhausted from an exhaust port 13, so that the head valve 6 is opened, and compressed air in the air chamber 2 is suddenly supplied into the striking cylinder 3*a*, and the striking piston 3*b* is driven so as to drive a nail.

After the nail has been driven, the trigger lever 4 is returned. Then the valve stem 10 of the start valve 5 is moved downward by the action of a spring 15. At the same time, the pilot valve 11 is moved upward, and compressed air is supplied again from the air passage 12 to the upper chamber 14 of the head valve, so that the head valve 6 is closed, and at the same time, the discharge port is opened and the compressed air supplied into the striking cylinder 3*a* is discharged outside. At the same time, the striking piston 3*b* is moved upward by the compressed air, which was compressed in the process of striking, stored in the block chamber 16 arranged around the striking cylinder 3*a*. Therefore, the striking piston 3*b* returns to the initial uppermost point so as to prepare the next nail driving operation.

In this connection, the exhaust air discharged from the striking cylinder 3*b* after the completion of driving a nail is discharged outside by the exhaust mechanism shown as follows.

In the upper portion of the striking cylinder 3*a*, there is provided a cylindrical inner cap 17 having a bottom, in which a drive valve mechanism (head valve 6) is accommodated. By the drive valve mechanism, the striking cylinder 3*a* is changed over between the air supply source and the atmosphere. In the inner cap 17, there is provided an exhaust hole 18 for the exhaust air discharged from the striking cylinder 3*a*. The circumference of the inner cap 17 is covered with a cylinder cap 19. Between the inner cap 17 and the cylinder cap 19, there is provided an exhaust chamber 20 that is formed along the inside of the body 1. The exhaust chamber 20 is a space for diffusing the exhaust air sent from the striking cylinder and piston mechanism. Inside the cylinder cap at the lower end portion, there is formed a throttle hole 21 for discharging the exhaust air sent from the exhaust chamber 20.

Figure 5:
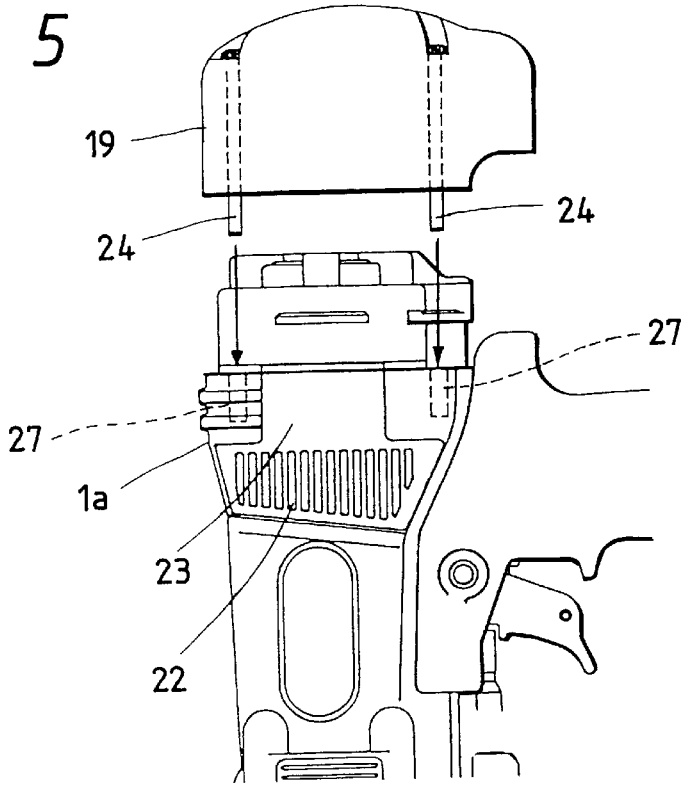
FIG. 5 is a schematic illustration showing a connecting condition of the main body with the cylinder cap.
Figure 6:
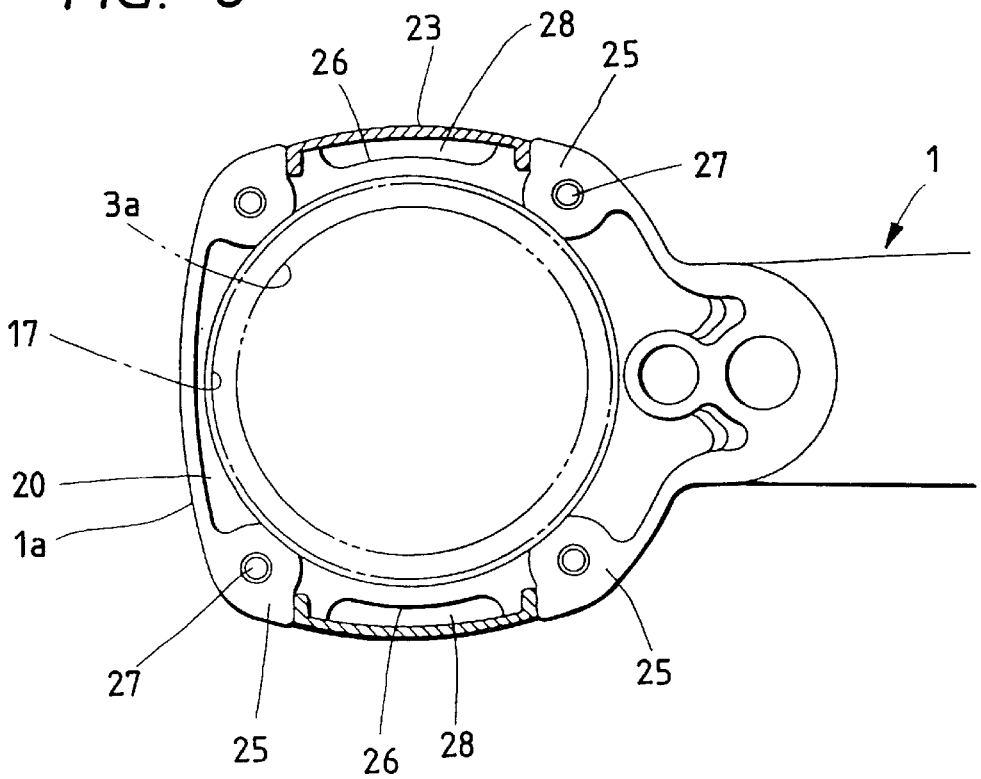
FIG. 6 is a transverse cross-sectional view of the portion in which the exhaust cover is attached.
Figure 7:
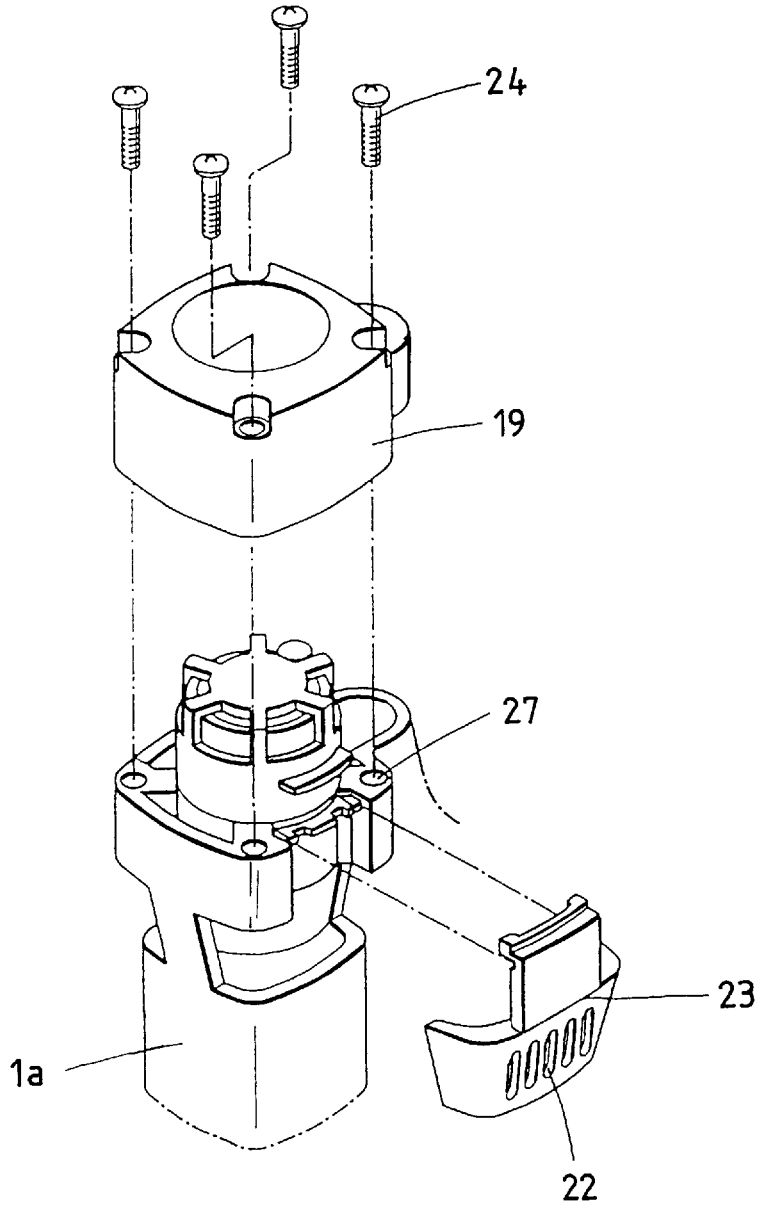
FIG. 7 is an exploded perspective view of the upper portion of the main body of the nailing machine.

In this connection, as shown in FIGS. 5 to 7, the body 1 is arranged as follows. The lower end surface of the cylinder cap 19 is butted to the upper end surface of the main body la having the striking cylinder-piston mechanism, and both of them are integrally connected with each other by the fixing bolts 24.

Although the wall thickness of the main body 1*a* is small, it is formed to be cylindrical, so that the pressure proof property can be ensured. At the upper end of the main body 1*a*, both sides are formed into the same cylindrical shape, the wall thickness of which is small, as that of the outside of the inner cap 17. At the upper end of the main body 1*a*, on the sides perpendicular to both sides described above, four protrusions 25, the wall thickness of which is large, are formed, and a portion of the exhaust chamber 20 is formed when the outside of the protrusions 25 are connected with each other by a large arc. The lower portion of the main body la is formed to be cylindrical, and the air chamber 2 and the blow-back chamber 16 are defined between the main body 1*a* and the outer circumferential surface of the striking cylinder 3*a*. Between the protrusions 25 which are adjacent to each other, there is formed a recess 26, the wall thickness of which is small. In the protrusion 25, there is formed an attaching hole 27. The attaching hole 27 is open to the upper end surface of the main body 1*a*. The reason why the protrusions 25 are formed on the main body la by means of padding is that the portions around the attaching holes 27 are weakest in the mechanical strength when pressure is applied.

In the cylinder cap 19, there are provided insertion holes, into which the fixing bolts 24 are inserted, corresponding to the protrusions 25 of the main body 1*a*. The fixing bolts 24 inserted into these insertion holes are screwed into the attaching holes 27 open to the upper end surface of the main body 1*a*. Inside the cylinder cap 19 at the lower end portion, there is formed a throttle hole 21 for discharging the exhaust air sent from the exhaust chamber 20.

Next, as shown in FIGS. 1, 3, 5, 6 and 7, at the lower portion of the exhaust chamber 20 inside the cylinder cap 19, there is provided an exhaust cover 23. The exhaust cover 23 has a large number of exhaust holes 22 and covers the outside of the recess 26, the wall thickness of which is small, formed between the protrusions 25 which are adjacent to each other. Due to the foregoing arrangement, an exhaust passage 28 is formed between the exhaust cover 23 and the recess 26. The upper end of this exhaust passage 28 is open to the throttle hole 21.

When the head valve 6 is closed as shown in FIG. 2 in the above arrangement, the exhaust port 18 of the inner cap 17 is opened. Accordingly, the striking piston 3*b* is moved upward, that is, the striking piston 3*b* is returned. Therefore, the exhaust air discharged from the upper portion of the striking cylinder 3*a* is diffused from the exhaust port 18 into the exhaust chamber 20. Further, the exhaust air in the exhaust chamber 20 passes through the throttle hole 21 and is discharged outside from the exhaust port 22 of the exhaust cover 23.

As described above, the exhaust air discharged from the striking cylinder 3*a* is diffused from the exhaust port 18 into the exhaust chamber 20 at a stroke. Further, the exhaust air in the exhaust chamber 20 is diffused and discharged from the throttle hole 21. Therefore, compared with a case in which the exhaust air is directly discharged outside from the exhaust port 18, the level of exhaust sound of the nailing machine of this embodiment is remarkably reduced. In this case, the exhaust chamber 20 is formed along the side of the body 1. Accordingly, the exhaust chamber 20 can be ensured without increasing the total height of the nailing machine. From this viewpoint, it is possible to avoid the increase in the size of the nailing machine.

In the above nailing machine, the wall thickness of a portion in which padding is not required is reduced. Due to the foregoing, the recess 26 is formed between the protrusions 25 adjacent to each other. This recess 26 is used as an attaching portion in which the exhaust cover 23 is attached. Therefore, the size of the overall body is not increased more than the needed size.

Since a large number of exhaust holes 22 are formed on the exhaust cover 23, the exhaust air that has been once discharged from the throttle hole 21 into the exhaust cover 23 is diffused and discharged from the large number of exhaust holes 22. Accordingly, the effect of sound reduction can be more enhanced, and at the same time the wind pressure of the exhaust air can be reduced. Therefore, no dust is raised during the work. Consequently, the nailing operation can be smoothly conducted.

Figure 8:
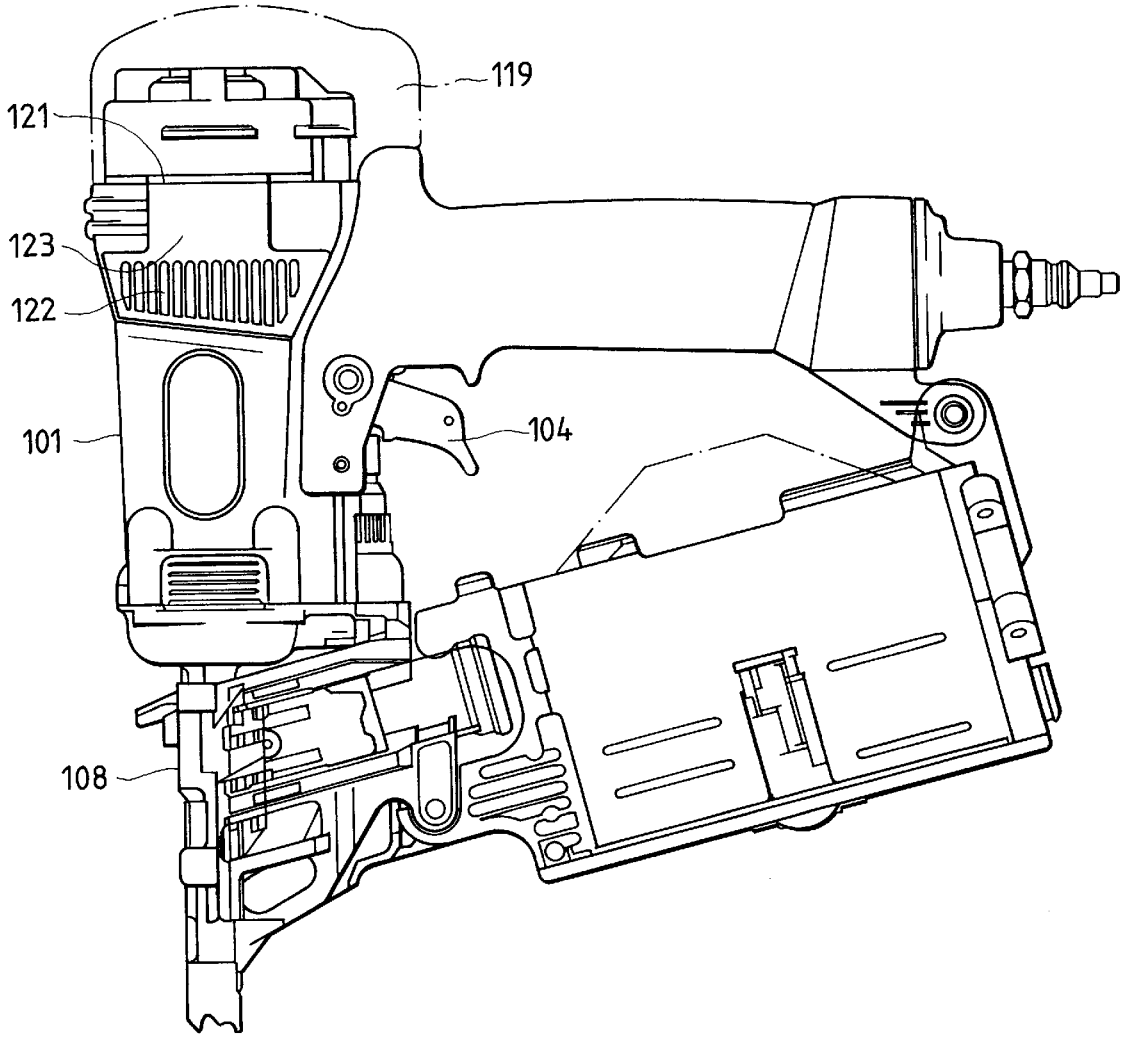
FIG. 8 is a side view of another nailing machine according to the present invention.
Figure 9:
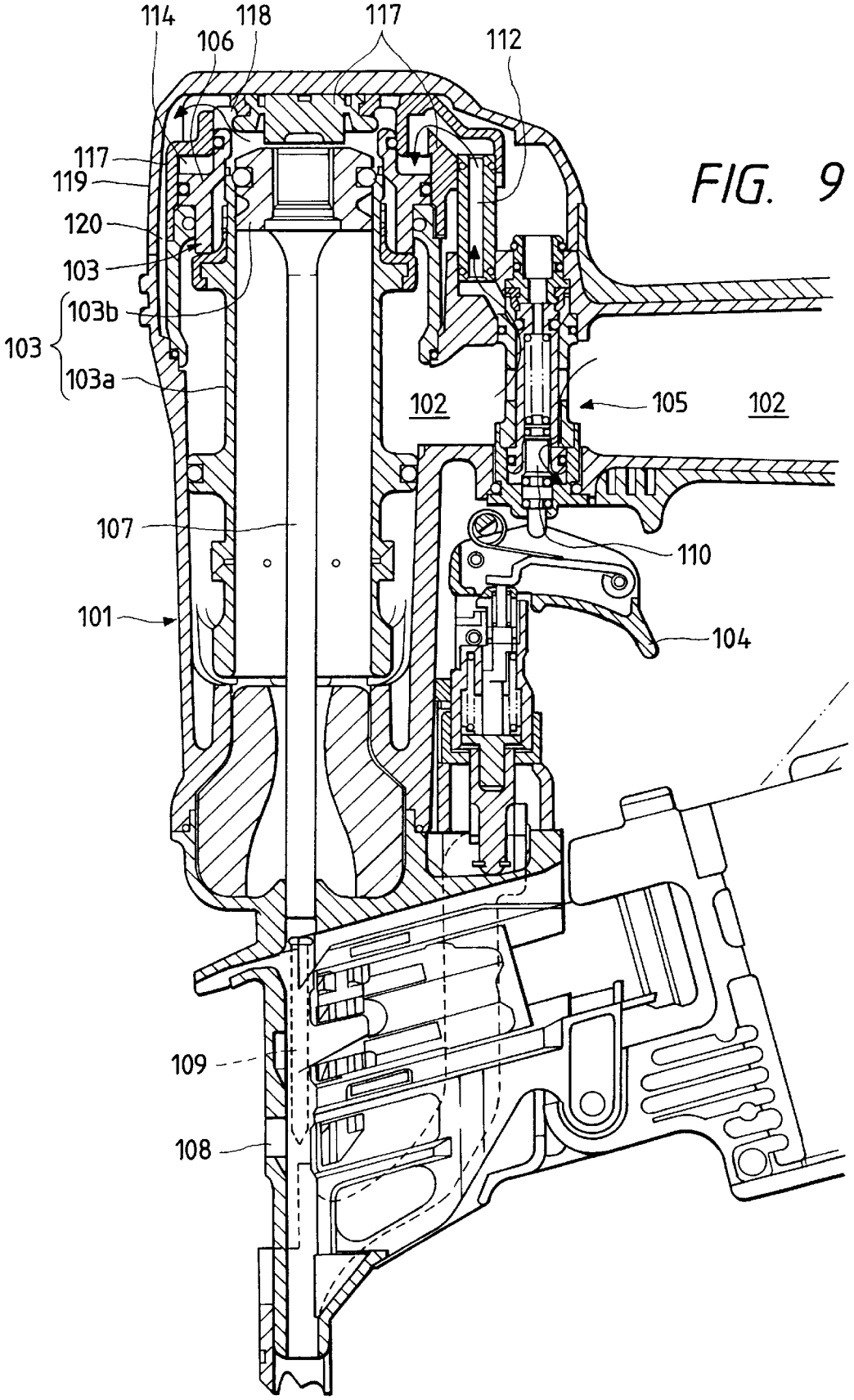
FIG. 9 is a longitudinal cross-sectional view of the above nailing machine.
Figure 10:
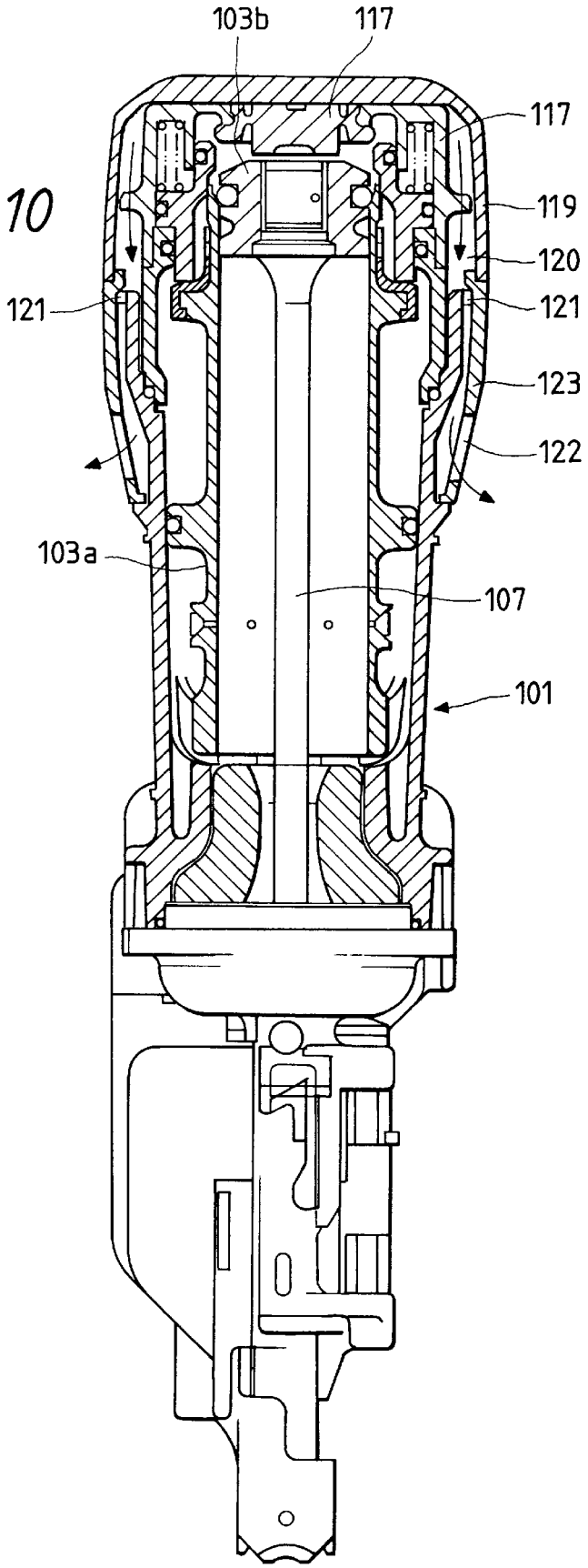
FIG. 10 is a longitudinal cross-sectional view of the primary portion of the body of the above nailing machine, wherein the view is taken on a cross section perpendicular to FIG. 9.

FIGS. 8, 9 and 10 are views showing another nailing machine of the present invention. This nailing machine is similar to the nailing machine of the first embodiment as follows. In the body 101, there are provided an air chamber 102 to store compressed air supplied from a compressed air source (not shown), and a striking cylinder-piston mechanism 103. When a trigger lever 104 is pulled by an operator, compressed air is supplied to and discharged from a striking cylinder 103*a* by the operation of a start valve 105 and a head valve 106 which are interlocked with the trigger lever 104. By the action of the compressed air, a striking piston 103*b* is reciprocated in the striking cylinder 103*a*. Therefore, a driver 107 integrally connected with the striking piston 103*b* is shot to a nose portion 108 arranged at an end of the body 101, so that a nail 109 supplied to an outlet of the nose portion 108 is struck by the driver 107. In this way, the nail 109 is driven into an object to be nailed.

Figure 11:
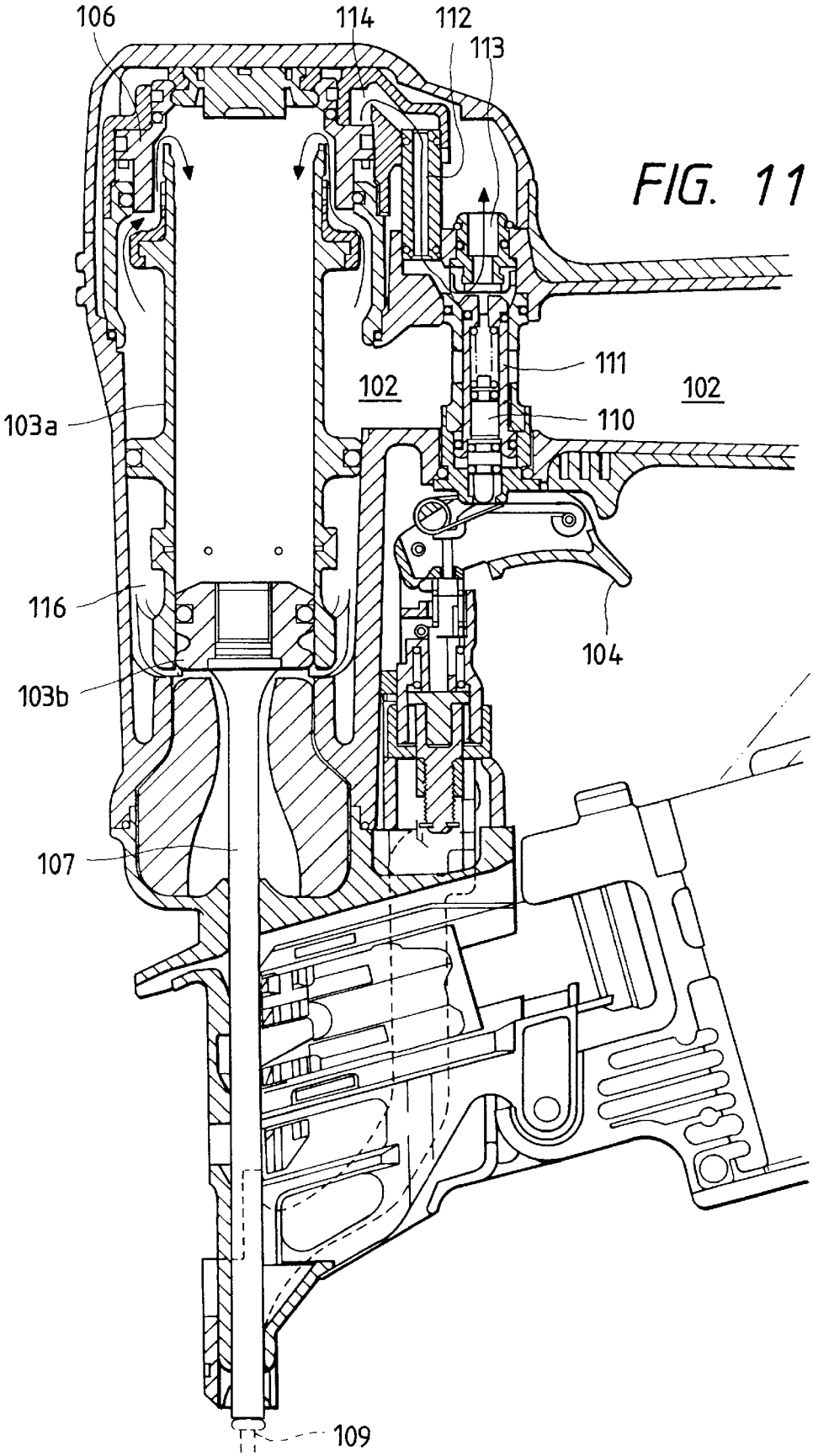
FIG. 11 is a longitudinal cross-sectional view of the primary portion of the body of the above nailing machine in the case of driving a nail.

As shown in FIG. 11, the trigger lever 104 pushes a stem 110 of the start valve 105, so that a pilot valve 111 is moved downward and an air passage 112 is open to an exhaust port 113. Due to the foregoing, compressed air in an upper chamber 114 of the head valve 106 is exhausted from an exhaust port 113, so that the head valve 106 is opened, and compressed air in the air chamber 102 is suddenly supplied into the striking cylinder 103*a*, and the striking piston 103*b* is driven so as to drive a nail.

After the nail has been driven, the trigger lever 104 is returned. Then the valve stem 110 of the start valve 105 is moved downward by the action of a spring 115. At the same time, the pilot valve 111 is moved upward, and compressed air is supplied again from the air passage 112 to the upper chamber 114 of the head valve, so that the head valve 106 is closed, and at the same time, the discharge port is opened and the compressed air supplied into the striking cylinder 103*a* is discharged outside. At the same time, the striking piston 103*b* is moved upward by the compressed air, which was compressed in the process of striking, stored in the blow-back chamber 116 arranged around the striking cylinder 103*a*. Therefore, the striking piston 103*b* returns to the initial uppermost point so as to prepare the next nail driving operation.

In this connection, when the compressed air is discharged from the striking cylinder 103*a* after the striking piston 103*b* has been driven, exhaust sound is generated. The level of this exhaust sound is reduced by the following sound level reduction mechanism. In an upper portion of the above striking cylinder 103*a*, there is provided an inner cap 117 in which the head valve 106 is accommodated. In the inner cap 117, there is provided an exhaust hole 118 for the exhaust air discharged from the striking cylinder 103*a*. The circumference of the inner cap 117 is covered with a cylinder cap 119. Between the inner cap 117 and the cylinder cap 119, an exhaust chamber 120 is formed along the inside of the body 101. In the lower portion of the exhaust chamber 120, there is provided a throttle hole 121. In the lower portion of the throttle hole 121, there is provided an exhaust cover 123 on which a large number of exhaust holes 122 are formed.

In this connection, when the head valve 106 is closed, the exhaust port 118 of the inner cap 117 is opened. When the head valve 106 is opened, the exhaust port 118 of the inner cap 117 is closed.

In the above arrangement, when the head valve 102 is closed as shown in FIG. 9, the exhaust port 118 of the inner cap 117 is opened. Accordingly, the striking piston 103*b* is moved upward, that is, the striking piston 103*b* is returned, and the exhaust air discharged from the upper portion of the striking cylinder 103*a* is discharged from the exhaust port 118 into the exhaust chamber 120. Further, the exhaust air in the exhaust chamber 120 passes through the throttle hole 121 and diffuses from the exhaust port 122 on the exhaust cover 123. In this way, the exhaust air is discharged outside.

As described above, the exhaust air discharged from the striking cylinder 103*a* is sent from the exhaust port 118 of the inner cap 117 into the exhaust chamber 120 at a stroke. Further, the exhaust air in the exhaust chamber 120 is diffused and discharged from the throttle port 121. Therefore, the level of exhaust sound is remarkably reduced as compared with an arrangement in which the exhaust air is directly discharged outside from the exhaust port 118.

Further, the exhaust air discharged from the striking cylinder 103*a* is quickly sent into the exhaust chamber 120. Accordingly, the exhaust of air from the striking cylinder 103*a* is not delayed. Therefore, the returning performance of the striking piston 103*b* is not deteriorated even if the sound of exhaust air is reduced as described above.

In the present invention, the exhaust chamber 120 is not provided in such a manner that a cover is simply attached to the outer circumference of the cylinder cap 119 while a space is provided between the cylinder cap 119 and the cover, but the exhaust chamber 120 is formed along the side of the body 101. Accordingly, even if the height of the overall nailing machine is not increased, the exhaust air chamber 120 can be positively formed. From this viewpoint, the nailing machine can be made compact.

Figure 12:
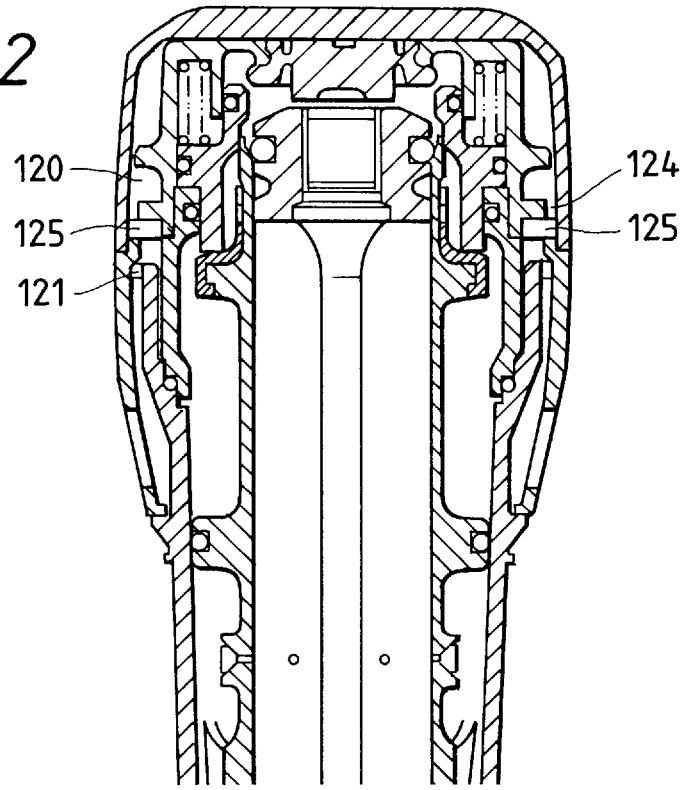
FIG. 12 is a cross-sectional view of the primary portion of another example of the exhaust chamber.
Figure 13:
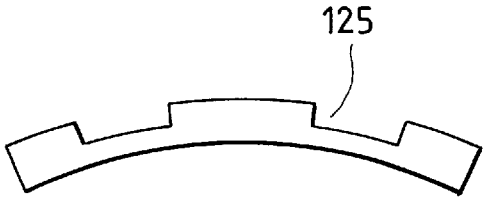
FIG. 13 is a plan view of the baffle member.

In this connection, the size of the throttle hole 121 may be adjusted to be small as follows. As shown in FIG. 12, an attaching space 124 is formed in the upper portion of the throttle hole 121 of the exhaust chamber 120. In this attaching space 124, there is provided an arcuate baffle member 125 shown in FIG. 13. Due to this baffle member 125, the size of the throttle hole 121 can be more reduced.

The size of the throttle hole 121 of the exhaust chamber 120 is adjustable as described above. Accordingly, in a packing work in which they attach importance to the speed of driving nails even if the level of sound is raised, the above baffle member 125 is not attached. In a conventional architectural method in which they attach importance to the effect of sound reduction rather than the speed of driving nails, the above baffle member 125 is attached so as to enhance the effect of sound reduction.

Figure 14:
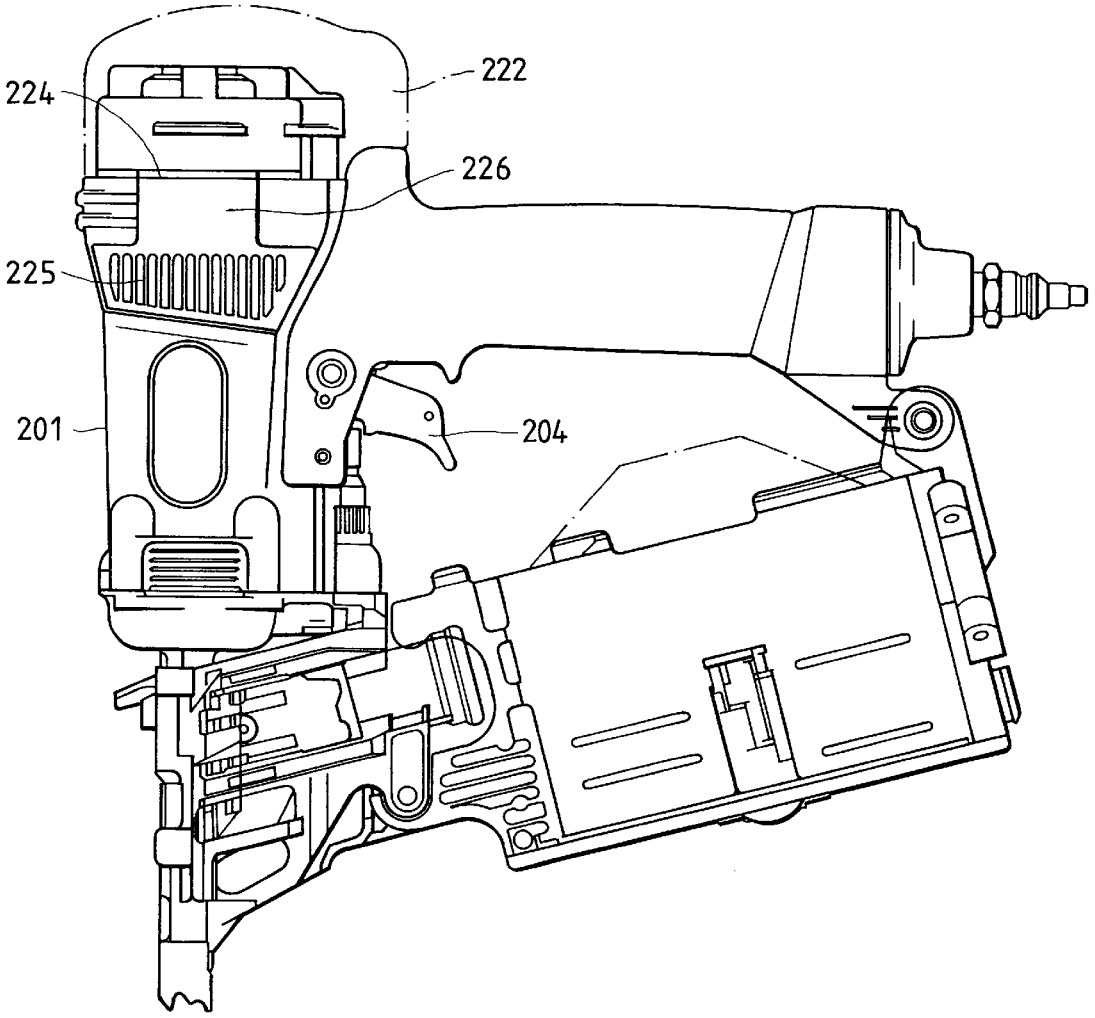
FIG. 14 is a side view of still further nailing machine according to the present invention.
Figure 15:
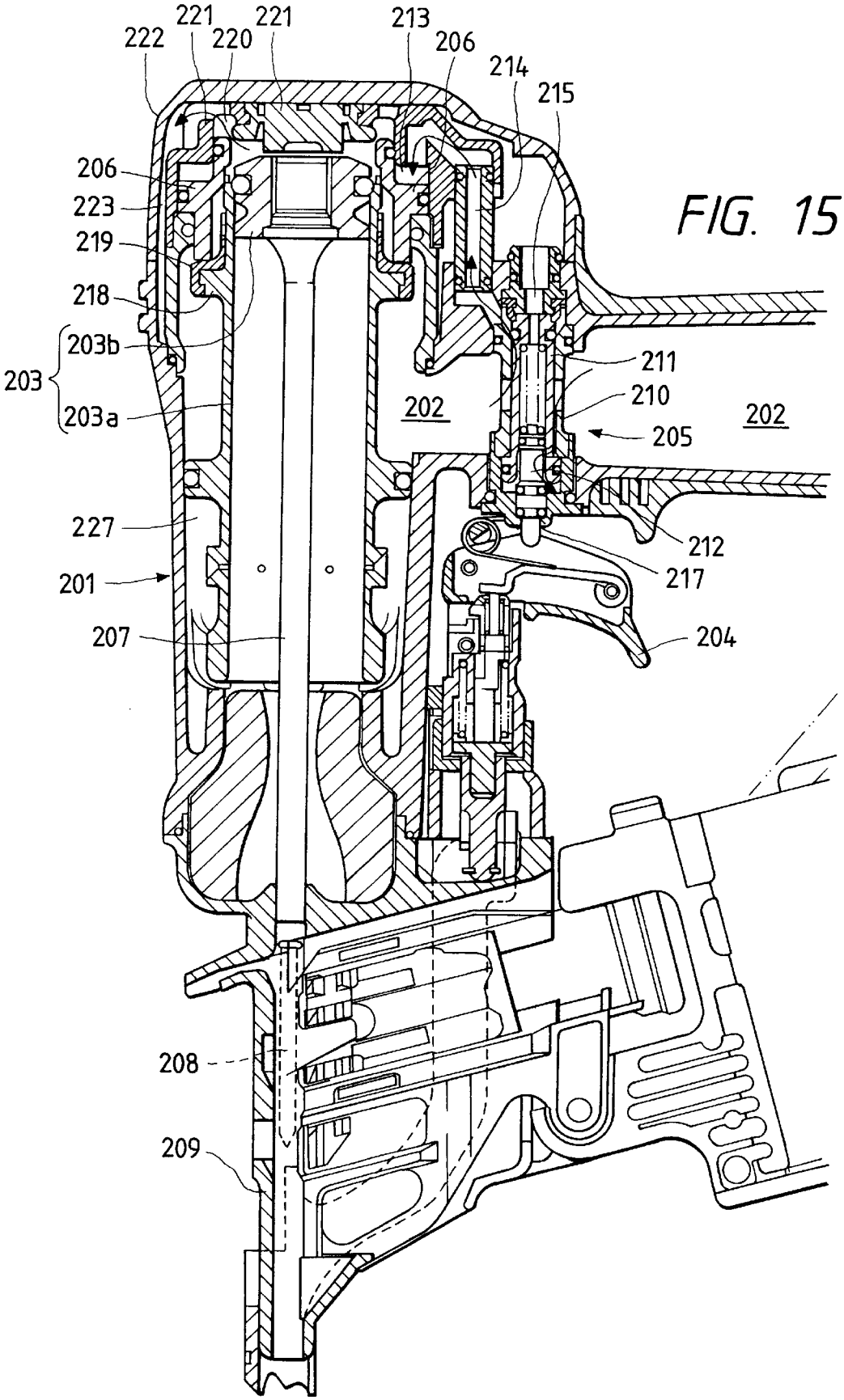
FIG. 15 is a longitudinal cross-sectional view of the above nailing machine.
Figure 16:
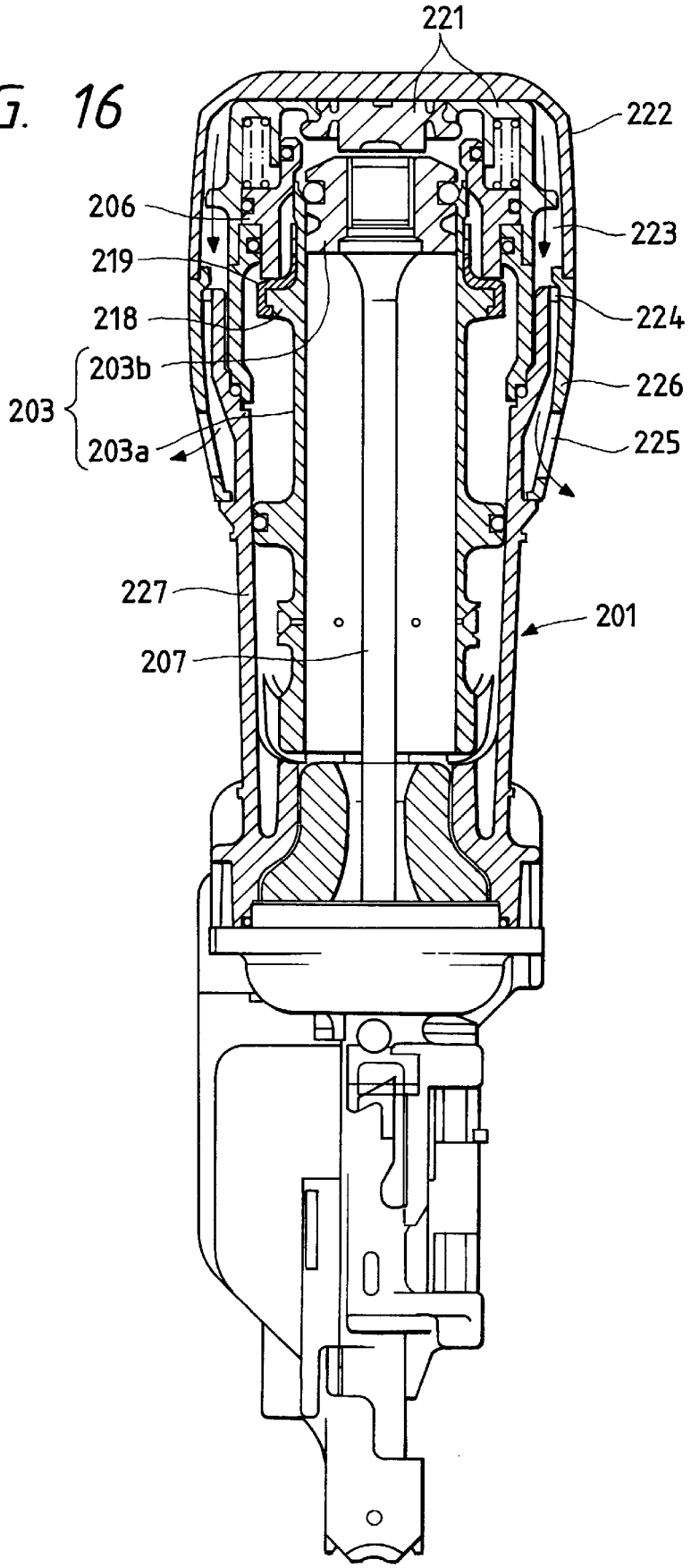
FIG. 16 is a longitudinal cross-sectional view of the primary portion of the body of the above nailing machine taken on the section perpendicular to FIG. 15.

FIGS. 14, 15 and 16 are views showing still further nailing machine of the present invention. This nailing machine is arranged as follows. In the body 201, there are provided an air chamber 202 to store compressed air of high pressure supplied from a compressed air source (not shown), and a cylindrical striking cylinder-piston mechanism 203. When a trigger lever 204 is pulled by an operator, compressed air is supplied to and discharged from a striking cylinder 203*a* by the operation of a start valve 205 and a head valve 206 which are interlocked with the trigger lever 204. By the action of the compressed air, a striking piston 203*b* is reciprocated in the striking cylinder 203*a*. Therefore, a driver 207 integrally connected with the striking piston 203*b* is shot to a nose portion 209 arranged at an end of the body 201, so that a nail 208 supplied to an outlet of the nose portion 209 is struck by the driver 207. In this way, the nail 208 is driven into an object to be nailed.

Figure 17:
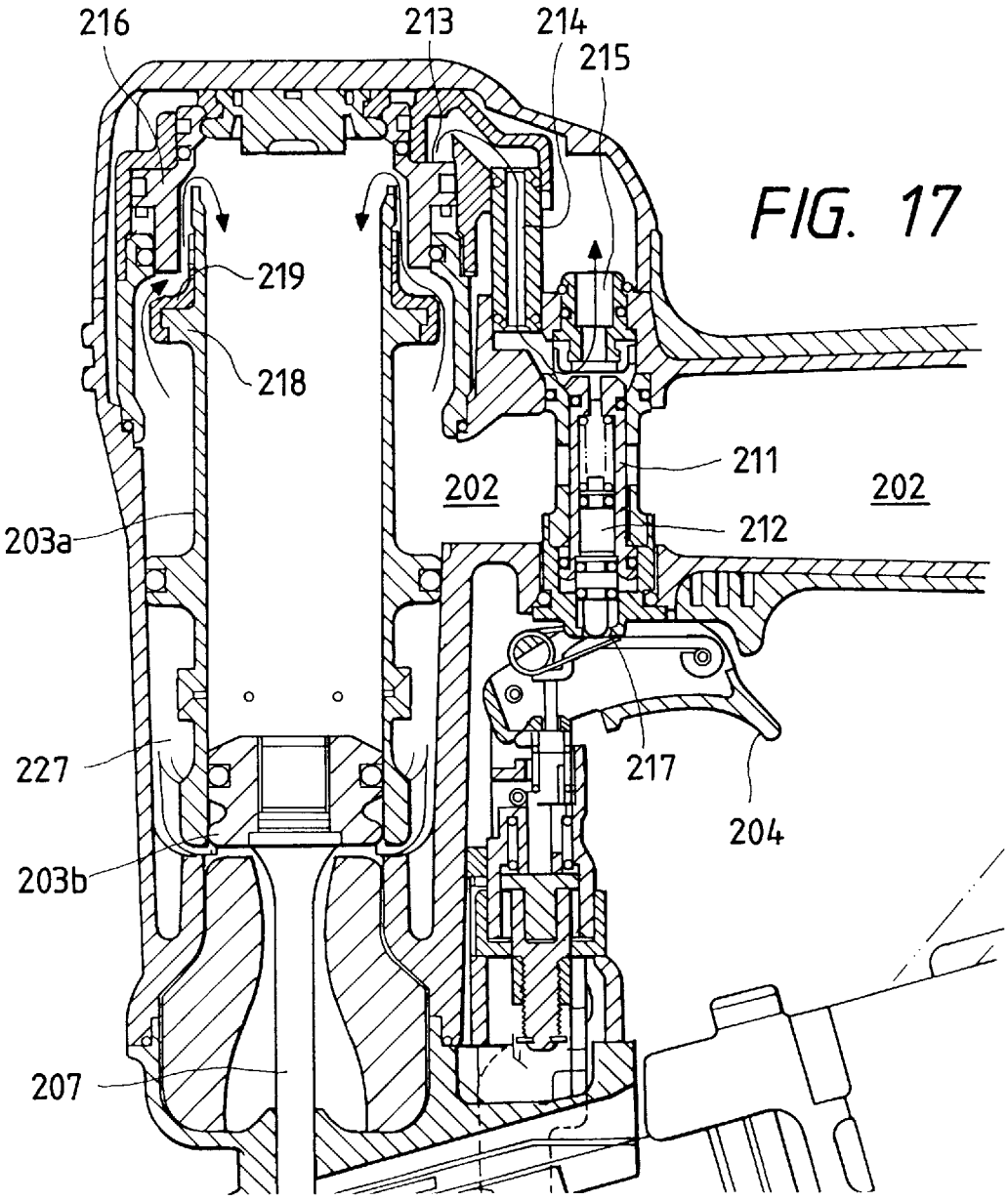
FIG. 17 is a longitudinal cross-sectional view of the primary portion in the case of driving a nail.

The start valve 205 includes a cylindrical pilot valve 211 slidably arranged in the valve housing 210, and a valve stem 212 slidably arranged in the pilot valve 211. Usually, the compressed air sent from the air chamber 202 is supplied between the pilot valve 211 and the lower bottom portion of the valve housing 210, so that the pilot valve 211 can be pushed upward. By the pilot valve 211 moved upward, the air passage 214 communicated with the upper chamber 213 of the head valve 206 is opened to the air chamber 202, and the exhaust port 215 of the upper end of the valve housing 210 is closed. When the valve stem 212 is pushed, resisting the spring force, by the operation of the trigger lever 204 as shown in FIG. 17, the compressed air, which has been supplied, is discharged from the stem guide hole 217 at the lower end of the valve housing 210. Due to the foregoing, the pilot valve 211 is moved downward, so that the air passage 214 is closed to the air chamber 202 and opened to the exhaust port 215 arranged at the upper end of the valve housing 210.

On the upper outside of the striking cylinder 203*a*, there is provided an annular protruding edge 218. In the upper portion of the protruding edge 218, a short cylindrical head valve 206 is arranged on the same axis as that of the striking cylinder 203*a*, and this head valve 206 can be slid upward and downward. The protruding edge 218 and the outer wall surface of the striking cylinder 203*a* are covered with a cover 219 integrally made of rubber.

In the initial condition shown in FIGS. 15 and 16, the lower end of the head valve 206 comes into contact with the protruding edge 218 and receives a force generated by the compressed air introduced from the air chamber 202. There is provided an upper chamber 213 in the upper portion of the head valve 206. This upper chamber 213 is communicated with the start valve 205 via the air passage 214. When the compressed air is supplied to the upper chamber 213, the head valve 206 is located at a lower position, and the lower end of the head valve 206 comes into contact with the protruding edge 218, so that the air chamber 202 is closed to the striking cylinder 203*a*. When the compressed air is discharged from the upper chamber 213 as shown in FIG. 17, the head valve 206 is slid upward, and the lower end of the head valve 206 is separated from the protruding edge 218, so that the air passage between the striking cylinder 203*a* and the head valve 206 is opened, and the air chamber 202 is connected with the striking cylinder 203*a*.

In the upper portion of the striking cylinder 203*a*, there is provided an inner cap 221 having an exhaust port 220. There is provided a cylinder cap 222 around the inner cap 221. As shown in FIGS. 15 and 16, there is provided an exhaust chamber 223 between the cylinder cap 222 and the inner cap 221. In the lower portion of the exhaust chamber 223, there is provided a throttle hole 224. In the lower portion of the throttle hole 224, there is provided an exhaust cover 226 having an exhaust port 225. As described above, the exhaust air discharged from the exhaust hole 220 of the inner cap 221 is discharged outside via the exhaust chamber 223 formed along the inside of the body 201.

When the head valve 206 is closed, the exhaust hole 220 of the inner cap 221 is opened. When the head valve 206 is opened, the exhaust hole 220 of the inner cap 221 is closed.

In the case of driving a nail in the above arrangement, the trigger lever 204 is pulled as shown in FIG. 17 so that the valve stem 212 of the start valve 205 is pushed. Then the pilot valve 211 is moved downward, and the air passage 214 is opened to the exhaust port 215, so that the compressed air in the upper chamber 213 is discharged from the exhaust port 215, and the head valve 206 is opened. Therefore, the compressed air in the air chamber 202 is suddenly supplied into the striking cylinder 203*a* via the air passage formed between the striking cylinder 203*a* and the head valve 206. When the compressed air in the air chamber 202 is suddenly supplied into the striking cylinder 203*a*, the striking piston 203*b* is driven.

After a nail has been driven, the trigger lever 204 is returned. Then, as shown in FIG. 15, the valve stem 212 of the start valve 205 is moved downward by the action of a spring. At the same time, the pilot valve 211 is moved upward, and compressed air is supplied again from the air passage 214 to the upper chamber 213 of the head valve, so that the head valve 206 is closed, and at the same time, the discharge port 220 of the inner cap 221 is opened and the compressed air supplied into the striking cylinder 203*a* is discharged outside from the exhaust chamber 223 via the exhaust port 215. At the same time, the striking piston 203*b* is moved upward by the compressed air, which was compressed by the striking piston 203*b* in the process of striking, stored in the block chamber 227 arranged around the striking cylinder 203*a*. Therefore, the striking piston 203*b* moves upward and returns to the initial uppermost point so as to prepare the next nail driving operation.

Next, as described above, when the head valve 206 is operated, the air passage is formed between the striking cylinder 203*a* and the head valve 206 as shown in FIG. 17. When the head valve 206 is opened and the compressed air of high pressure is supplied into the striking cylinder 203*a*, the inner pressure of which has been reduced in the previous exhaust operation, the compressed air is suddenly expanded. Due to this adiabatic expansion, temperatures of the protruding edge 218 of the striking cylinder 203*a* and the upper outer wall surface are lowered. However, these portions are covered with the cover 219 made of rubber. Accordingly, even if the moisture contained in the compressed air is frozen and ice is generated, it is difficult for the generated ice to adhere to the cover 219 made of elastic rubber, the heat insulating property of which is high. Even if the ice adheres to the cover 219, it can be easily removed. Therefore, the removed ice is easily blown off by the compressed air. Accordingly, the compressed air passage can be effectively prevented from freezing when the head valve 206 is opened. As a result, the head valve 206 can be sealed in a good condition and no air leaks out. Accordingly, the head valve 206 can be always operated properly.

In this connection, when the head valve 206 is made of synthetic resin, the heat insulating property of which is high, the freeze of moisture contained in the compressed air can be further prevented.

Figure 18:
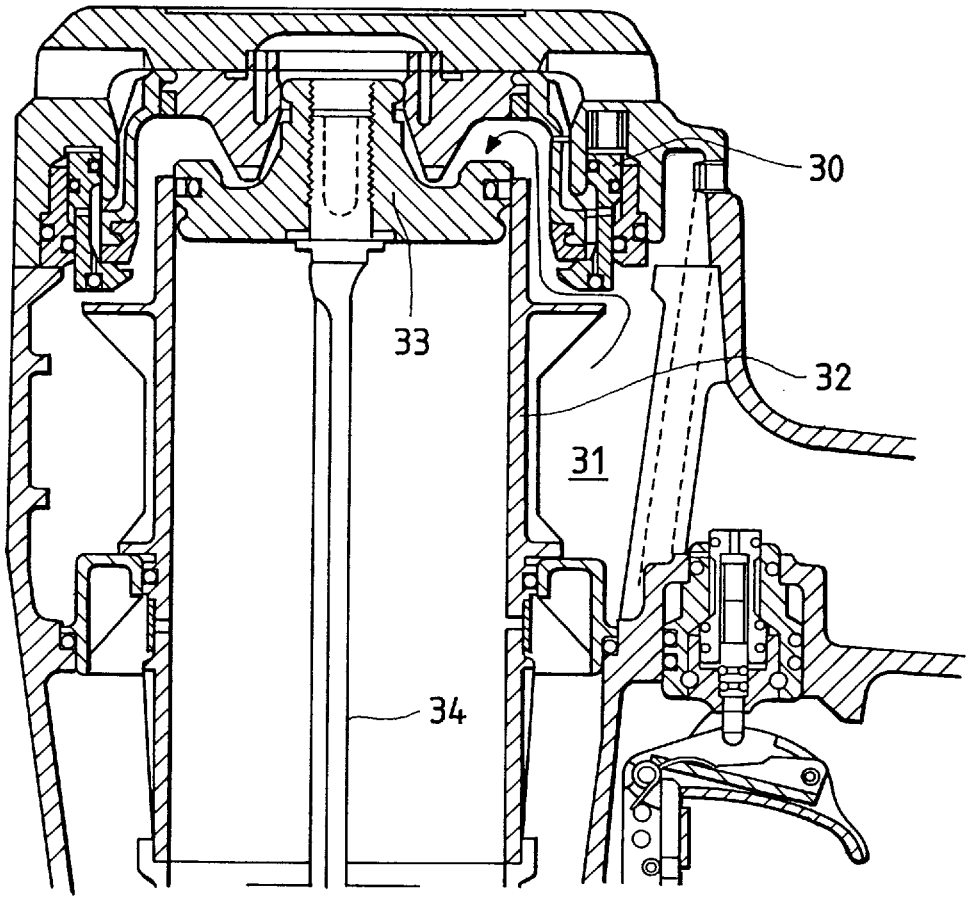
FIG. 18 PRIOR ART
FIG. 18 is a cross-sectional view of the head valve portion of a conventional nailing machine.

It should be noted that the head valve of the present invention is not limited to the above example. For example, the head valve may be arranged as shown in FIG. 18.

What is claimed is:

1. An exhaust mechanism for a pneumatic nailing device in which a striking cylinder-piston mechanism is accommodated in a body and a striking piston extends through a lower portion of the striking cylinder and is driven to drive a nail when compressed air is supplied to and exhausted from an upper portion of the striking cylinder, the exhaust mechanism comprising:

an inner cap arranged adjacent the upper portion of the striking cylinder;

a cylinder cap covering the inner cap and intersecting a plane perpendicular to a longitudinal axis of the striking cylinder, said plane also intersecting a portion of the striking cylinder;

an exhaust chamber formed substantially parallel to the longitudinal axis of the striking cylinder and along the body between the inner cap and the cylinder cap; and a throttle hole formed in a lower portion of the exhaust chamber, wherein the exhaust air exhausted from the upper portion of the striking cylinder is discharged from the throttle hole via the exhaust chamber.

2. The exhaust mechanism according to claim 1, wherein size of the throttle hole is adjustable.

3. The exhaust mechanism according to claim 1, further comprising:

a cover made of rubber attached outside the upper portion of the striking cylinder.

4. An exhaust mechanism for a pneumatic nailing machine in which a striking cylinder-piston mechanism is accommodated in a cylindrical main body and the striking cylinder-piston mechanism has a striking cylinder and a striking piston accommodated therein, the exhaust mechanism comprising:

a cylindrical cylinder cap having a bottom to cover an upper portion of the striking cylinder-piston mechanism, and a lower end surface of the cylinder cap being butted to an upper end surface of the main body;

an inner cap arranged inside the cylinder cap, the inner cap accommodating a drive valve mechanism for changing over the connection of the striking cylinder between an air supply source and the atmosphere;

an exhaust chamber formed between the inner cap and the cylinder cap, the exhaust chamber diffusing exhaust air sent from the striking cylinder-piston mechanism;

a throttle hole for discharging exhaust air sent from the exhaust chamber, the throttle hole being formed inside at a lower end of the cylinder cap;

a plurality of protrusions, a wall thickness of which is larger than adjacent thin wall portions, said protrusions arranged on a circumferential surface of the main body; and an exhaust cover having at least one exhaust port, the exhaust cover covering at least one of said thin wall portions, wherein an exhaust passage is formed between the exhaust cover and at least one of said thin wall portions, and an upper end of the exhaust passage is open to the throttle hole.

5. The exhaust mechanism according to claim 4, wherein size of the throttle hole is adjustable.

6. The exhaust mechanism according to claim 4, further comprising:

a cover made of rubber attached outside the upper portion of the striking cylinder.

7. An pneumatic nailing device, comprising:

a housing;

a piston and a cylinder accommodated in the housing, said cylinder having a compression chamber defined by sidewalls of the cylinder and an end cap of the cylinder, and said piston configured to drive a nail when compressed fluid is supplied to and exhausted from said compression chamber of said cylinder; and an exhaust mechanism located on said housing and including a cylinder cap surrounding said end cap of said cylinder and a portion of said sidewalls of said cylinder to form an exhaust chamber located between said cylinder and said cylinder cap;

wherein fluid exhausted from said compression chamber enters said exhaust chamber and travels along said sidewalls of said cylinder before it is exhausted to atmosphere.

8. A pneumatic nailing device according to claim 7, further comprising:

a throttle hole formed between said cylinder and said cylinder cap such that the exhaust fluid exhausted from said compression chamber is discharged from said throttle hole via said exhaust chamber.

9. A pneumatic nailing device according to claim 8, wherein a size of said throttle hole is adjustable.

10. A pneumatic nailing device according to claim 7, further comprising:

a rubber cover located on an exterior portion of said compression chamber.

11. A pneumatic nailing device according to claim 7, wherein said cylinder cap includes a portion that is concentric with a portion of said sidewalls of said cylinder.

* * * * *